US009272404B1

(12) United States Patent
Christensen

(10) Patent No.: US 9,272,404 B1
(45) Date of Patent: Mar. 1, 2016

(54) ROTATION TOOL

(76) Inventor: Walter M. Christensen, Fort Atkinson, WI (US)

( * ) Notice: Subject to any disclaimer, the term of this patent is extended or adjusted under 35 U.S.C. 154(b) by 0 days.

(21) Appl. No.: 13/154,085

(22) Filed: Jun. 14, 2011

(51) Int. Cl.
*B25B 33/00* (2006.01)

(52) U.S. Cl.
CPC ..... *B25B 33/00* (2013.01)

(58) Field of Classification Search
USPC ..... 464/51–53, 162; 29/240, DIG. 104; 81/57.43, 177.6, 177.2
See application file for complete search history.

(56) References Cited

U.S. PATENT DOCUMENTS 1,989,078 A * 1/1935 Brostrom
2,097,022 A * 10/1937 Donahue ..... 29/240 X
2,546,846 A * 3/1951 Atkin
3,579,677 A * 5/1971 Ullman ..... 81/177.6 X
4,304,025 A * 12/1981 Christensen
4,372,263 A 2/1983 Costa
4,688,427 A 8/1987 Hyland
5,944,586 A * 8/1999 Sevigny et al.
5,966,992 A * 10/1999 Kashuba ..... 464/52 X
2005/0009458 A1 1/2005 Uzumcu
2007/0171553 A1* 7/2007 Rigney

* cited by examiner

*Primary Examiner* — Gregory Binda
(74) *Attorney, Agent, or Firm* — Boardman & Clark LLP

(57) ABSTRACT

A tool for assessing rotatable objects in an engine by selectively imparting a rotation to a chosen number of the rotatable objects that includes an engagement member, a shaft portion, and a motor as a rotation source. In the preferred embodiment, the engagement member mounted on a first end of the shaft engages the rotatable object. A support member means is mounted on a second end of the extendable member or on the shaft. A rotation source is used to impart rotation on shaft and engagement member and thus to the rotatable object to be rotated as may be required to facilitate for the testing and adjustment procedures to be performed upon the rotatable member.

3 Claims, 6 Drawing Sheets

ROTATION TOOL

FIELD OF INVENTION

The tool relates generally to an apparatus to test rotatable objects. In a preferred form, the present tool relates to an apparatus to assess rotatable objects in an engine.

BACKGROUND OF THE INVENTION

The disclosed tool is used to engage a selected, rotatable object encountered by those working on machinery. Often, these rotatable objects are difficult to selectively rotate. For example, in an automobile engine, a pulley may need to be rotated to identify which individual pulley is failing or exhibiting signs of failure. However, these pulleys are difficult to reach, are interconnected by belts and are not independently powered. Therefore, it is very difficult to independently test each pulley. Currently, one must attempt to either have the engine running and thus powering all the connected pulleys or attempt to rotate the pulleys by hand. The first approach causes the pulleys to rotate at operational speeds but confounds identifying a specific problem due to noise and movement from the engine and other components. In addition, it is dangerous as the person attempting to identify the problem must do so near or even touching a motor in operation. The second is difficult because operation speeds cannot be reached, and it often is difficult to reach the pulleys themselves in confined spaces.

SUMMARY OF THE INVENTION

The disclosed tool addresses these problems by being powered independently from the engine, which reduces noise, interference and danger. It also is able to rotate objects at high speeds, which allows testing using operational speeds to accurately and realistically test for problems. This allows the tool's user to isolate and identify problems easier and more quickly than conventional methods.

The tool consists of an engagement member that engages the object to be tested. Preferably, this is a drum made from material that is durable but will not harm the tested rotated object, for example, an elastomeric compound. This engaging member rotates, and once in contact with the rotatable object to be tested, it imparts a rotation to the object. The engaging member is attached to a shaft with a locking interconnect to a rotation source that powers the rotation. This rotation source may be separate from the engagement member, such as compressed air driven devices such as a die grinder or it may be integrally connected into one device. The speed at which the tool may rotate may be variable, or it may be static. In some situations, it will be important to be able to vary the speed, but in others, it may not be. Therefore, the tool may be built to be variable.

This rotation source originates the rotation that rotates the engaging member. In between the two, there may be an extension means or a stabilization means or both. The extension means may be fixed, such as a solid metal shaft, or collapsible, such as a telescoping shaft. Either allows the engaging member to reach objects to be tested that would otherwise be difficult to reach by hand or traditional methods.

The stabilization means may be as simple as a handle to allow a person to guide the engaging means or a more static structure that attaches to another structure that could allow testing to be done for a longer duration or create a permanent structure for the tool to be housed and used by a person. For example, the support structure could clamp to an automobile's frame. In another, it is an independent, free standing structure.

A person using the tool to test a rotatable object would first remove any obstacles known to hinder rotation but not be part of the test. For example, if a person wants to test a singular pulley in a series of pulleys interconnected by a belt, the person must remove the belt. However, if the entire pulley system is to be tested, the belt would remain in place.

Next, the person would position the tool such that the engaging member is in contact with the rotatable object to be tested. The engaging member may already be rotating before contact or the rotation may begin after contact. Then, the engaging member imparts rotation to the tested object. The tested object will then rotate at a speed directed by the person. This allows the person to observe the rotation of the tested object, as well as any consequences of that rotation, allowing the user to isolate any problems. The person then may move on to the next object to be tested.

By having an extension means, the engagement member can reach rotatable objects not normally able to be reached. In many instances, the rotatable object is located in a position that is difficult to reach by current means and also difficult to determine what is occurring while the motor is operating. This tool allows this difficultly-placed object to be tested.

BRIEF DESCRIPTION OF THE DRAWINGS

FIG. 9A shows the flexible shaft and FIG. 9B shows a flexible and telescoping shaft.

FIG. 10 is a perspective side view of another embodiment of the device with a telescoping shaft with phantoms showing the shaft telescoped in.

DETAILED DESCRIPTION OF THE INVENTION

Figure 1:
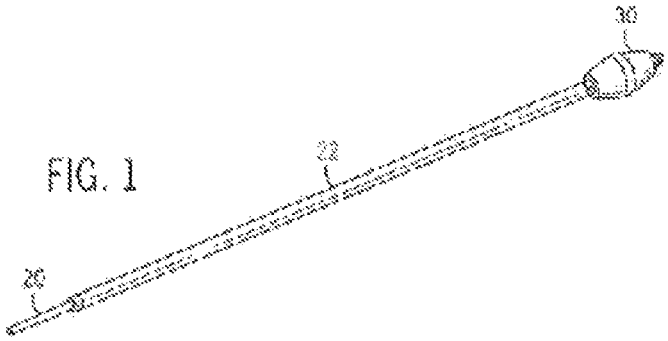
FIG. 1 is a perspective side view of the device
Figure 3:
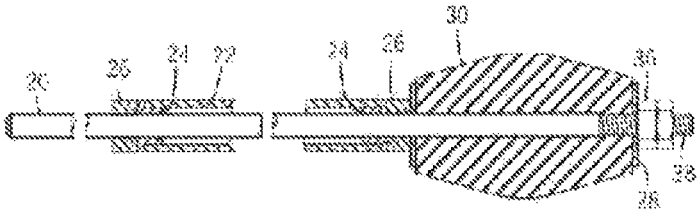
FIG. 3 is a plan cross-sectional view of the device.

The tool is used to impart rotation to a selected, rotatable item. The tool has an engagement member 30 that imparts rotation onto the selected item 423. The engagement member 30 can be in a variety of forms including, but not limited to, a solid drum as shown in FIG. 1 and FIG. 3, a smooth drum (FIG. 6), grooved drum (FIG. 5), or any other suitable shape that an average person skilled in the arts would recognize as functional.

Figure 4:
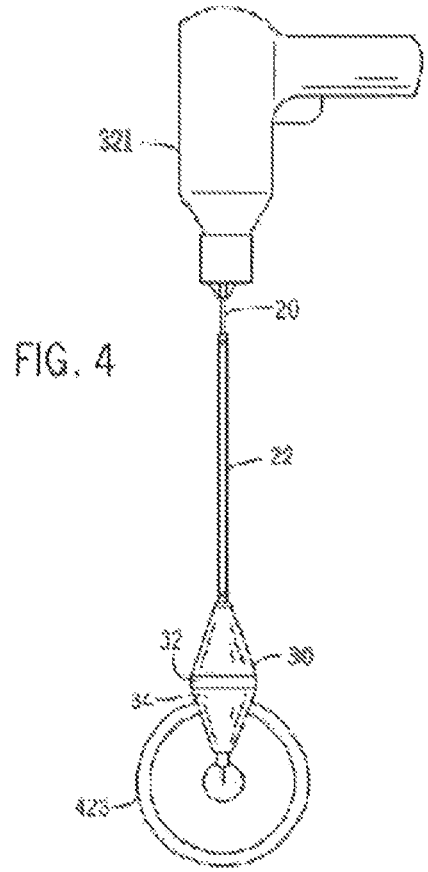
FIG. 4 is a plan side view of the device as attached to the power source and engaging a rotatable item.
Figure 8:
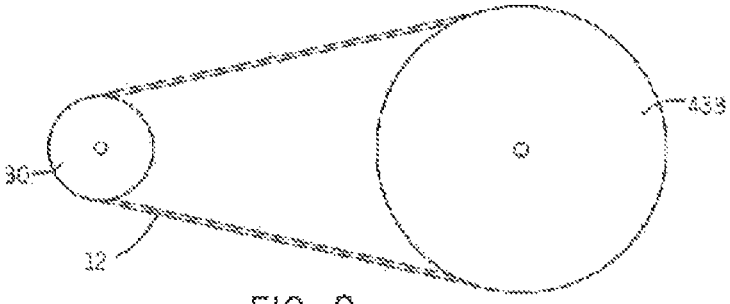
FIG. 8 is a front plan view of the device and rotatable item connected by a belt.

The engagement member 30 rotates due to a rotation source 321 imparting a rotation. Once the rotation source 321 imparts rotation on the shaft 20 which then transfers to the engagement member 30, the engagement member 30 then can cause rotation in a selected item 423 either through direct contact as shown in FIG. 4 or through an intermediary such as a belt 18 as shown in FIG. 8.

Figure 7:
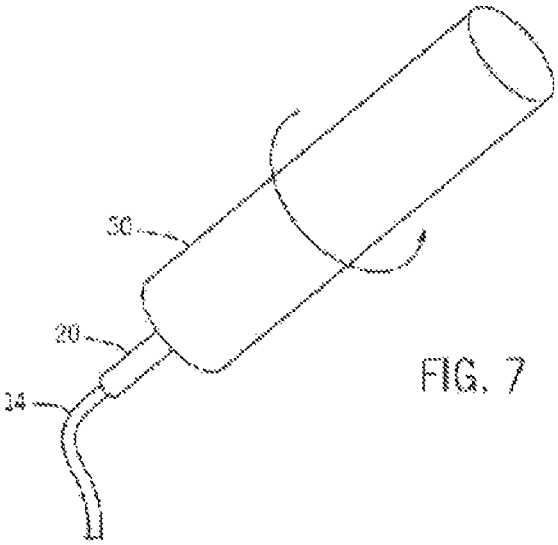
FIG. 7 is a perspective side view of another embodiment of the device.

As shown in FIG. 7 the rotation source 321 can be housed closer to or inside the engagement member 30 and is directly powered either through an independent or internal power source or external power source. The rotation source may also be external and similar to a drill as in FIG. 4 or die grinder or other compressed air or motor driven devices.

Figure 5:
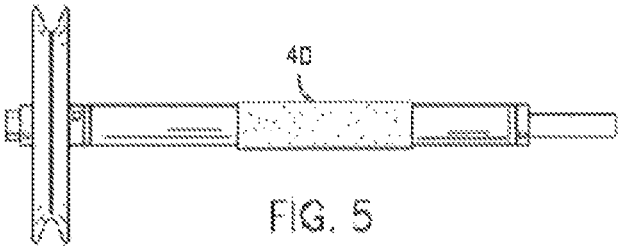
FIG. 5 is a plan side view of another embodiment of the device.

It may be preferred that the engagement member 30 is attached to shaft 20 in order to reach certain selected items. The elongated member 20 may be between the engagement member 30 and the rotation source 321 as shown in FIG. 4, or it may be used to extend the tool as it is shown in FIG. 7 where the rotation source 321 and engagement member 30 are housed together. In either case, the shaft may include, either in whole or in part, a flexible section 40 to allow the tool to reach even more difficult to access items as shown in FIG. 5.

Figure 2:
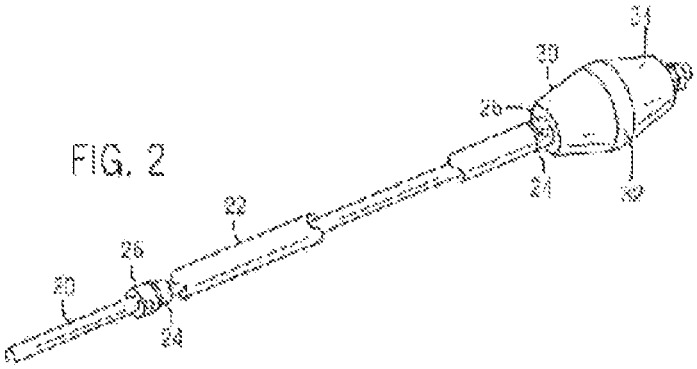
FIG. 2 is a perspective side view of the device with a cut away
Figure 6:
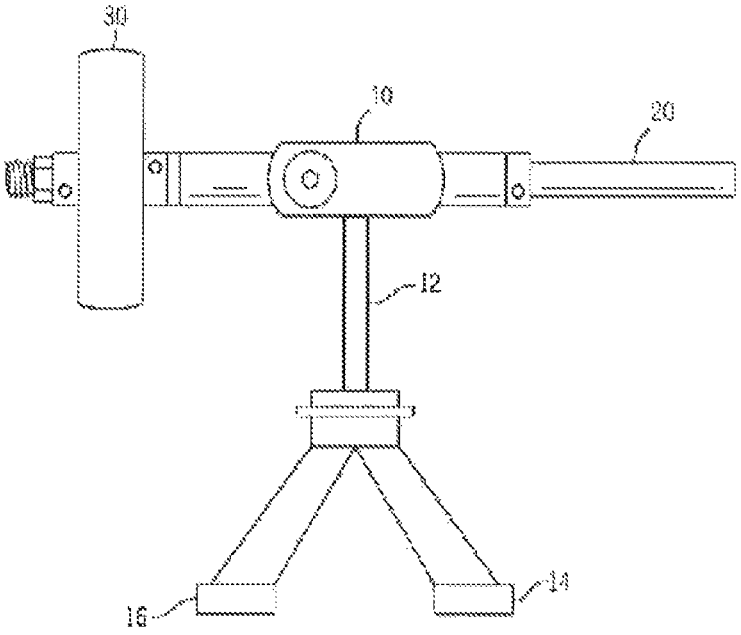
FIG. 6 is a plan side view of the device with stand.

In addition, the shaft 20 may be sheathed in a housing cover 22 as shown in FIG. 2 and FIG. 3. This housing cover 22 helps prevent unintended items such as the operator's clothing, hair, or jewelry from becoming ensnared in the rapidly rotating shaft 20. The shaft 20 continues to rotate, but the housing cover 22 need not rotate at all, or the housing cover 22 may simply stop rotating once something comes into contact with it. This housing cover 22 also allows the shaft to be rested on another object or even held as shown in FIG. 6 while the tool is in use.

In another embodiment, the rotating tool contains an engagement member, a shaft portion having a central longitudinal axis, and a motor encased in a housing. The shaft portion has a first end connected to the engagement member, and a second end connected to a rotary mechanism. The motor provides power to rotate the rotary mechanism. The rotary mechanism contains an output member that rotates the shaft. Additionally, the rotating tool contains a locking interconnect. This locking interconnect locks the engagement member to the shaft.

In a preferred embodiment, the motor can vary the speed of rotation of the engagement member. The motor may have variable speed using any means known to those of ordinary skill in the art. For example, the motor vary the power provided to the rotary mechanism using a variable resistor.

In a preferred embodiment, the locking interconnect locks the engagement member to the shaft using a locking means known to those of ordinary skill in the art, wherein said locking interconnect locks or unlocks the engagement member without tools. This locking interconnect allows a quick release of the engagement member so that it may be swapped for other engagement members without using tools.

Figure 12:
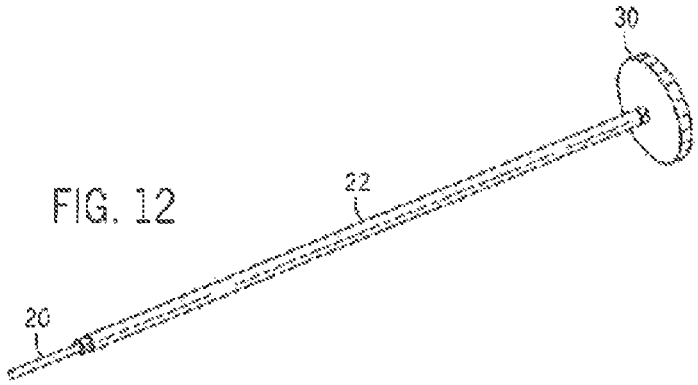
FIG. 12 is a perspective side view of one embodiment of the device, this embodiment having a toothed disk engagement member.

The shaft 20 could be cylindrical as shown or the cross-section could be other shapes such as rectangular, hexagonal or other polygonal shapes. The engagement member 30 could be shown in FIG. 1 as a solid drum with two opposing conical shapes with a flattened center allowing the taper of the conical sections to provide the user with a variety of speed ratios for testing and aids in tool placement in more or less confined spaces. However the engagement member 30 could be formed into other shapes including a simple cylinder as seen in FIG. 7 a grooved cylinder as in FIG. 6, or a sphere, gear or sprocket as in FIG. 12 as a person reasonably skilled would determine as best fitting the situation. FIG. 2 shows the housing cover 22 partially removed showing the shaft 20 as continuing through housing cover 22 attached to the engagement member 30.

In FIG. 2 and FIG. 3, optional components are shown. At the proximal end of the shaft 38 and attachment means 36 and a spacer 28. This spacer 28 may also be a means to help distribute force imparted by the attachment means on the engagement member 30. These help keep the engagement member 30 in place. The proximal end of the shaft 20 may be threaded depending on the attachment means 36 chosen. Although the attachment means 36 shown are nuts on a threaded tip 38 of the shaft 20, it is by no means limited to that as any number of attachment means 36 can be determined as functional by one skilled in the art. The housing cover 22 has spacers 24 on each end in order to reduce wear and tear on the cover due to the rotation of the rotatable item. These spacers 24 may be bearings or other means to reduce friction between the housing cover 22 and the shaft 20. However, such spacers are not required. There may also be attachment means 26 such as washers with nuts on either end of the housing cover 22 to prevent movement of the housing cover along the shaft 20. Again, such attachment means are not required, but each will assist in reducing harm to the housing cover 22 and engagement member 30.

FIG. 3 shows removable attachment means 36, which allows the engagement member to be removed and, thus, replaceable. The fasteners located on a threaded tip 38 of the shaft 20 also allow the engagement means 30 to be replaced with variable sizes and shapes while the rest of the tool remains the same. The shown removable attachment 36 means again is by no means limited to that as shown as any number of removable attachment means can be determined as functional by one skilled in the art.

In FIG. 4, the engagement member 30 is shown as a solid drum with several facets. The first is a centered flattened section 32, and the second are two conical sections 34. The conical sections 34 allow more contact between the engagement member 30 and the rotatable item 423. This allows the engagement member more control and even a longer reach. This choice of facets allows the operator more functionality and choice, but it is not necessary. A cylinder such as in FIG. 7 is functional even if it may wear more at the proximal tip due to more use.

FIG. 5 shows a flexible section 40 in the shaft 20 and housing cover 22 to allow the shaft to bend so that the engagement member 30 may reach into otherwise inaccessible areas.

FIG. 6 shows the device in a stand 12 with a clamping means 10 and stabilization means 14. The stand 12 allows the device to be used hands-free. The clamping means 10 connects to the housing cover 22 and the stabilization means 14 interfaces with another object to allow the stand 12 to be stable during use. The stabilization means 14 could be legs as shown or it could be another clamping means to allow clamping to a stable object such as an automobile frame. In addition, the feet 16 could be supplemented with suction cups or adhesive to allow a better connection for more stability.

FIG. 8 shows the device being used with a belt 18 intermediary between the engagement member 30 and another rotatable item 433. This allows the device to impart rotation even to items for which it may not be able to have direct contact. For this, the engagement member 30 as seen in FIG. 7 or FIG. 5 allow for the least chance of slippage of the belt 18.

Figure 9A:
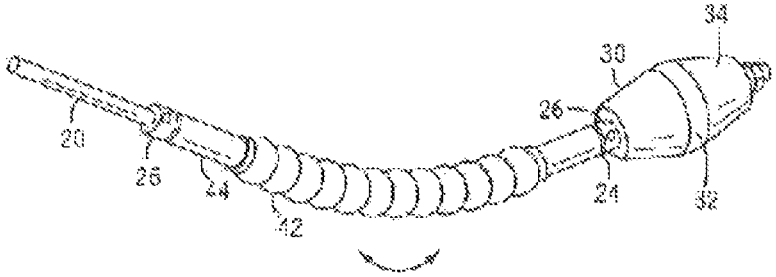
FIGS. 9A and 9B is a perspective side view of another embodiment of the device with a telescoping shaft.
Figure 9B:
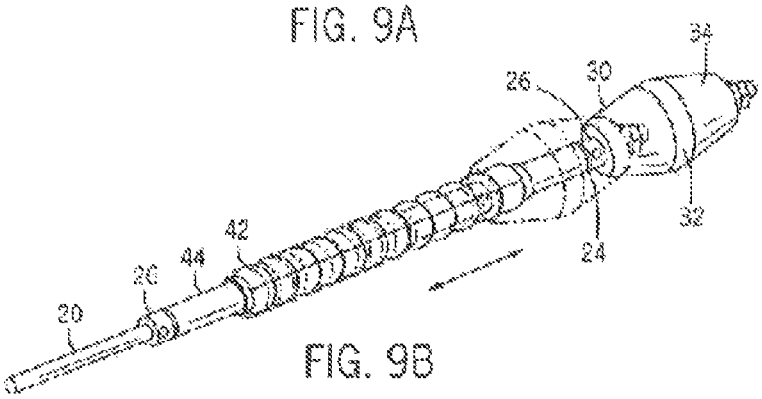
Figure 10:
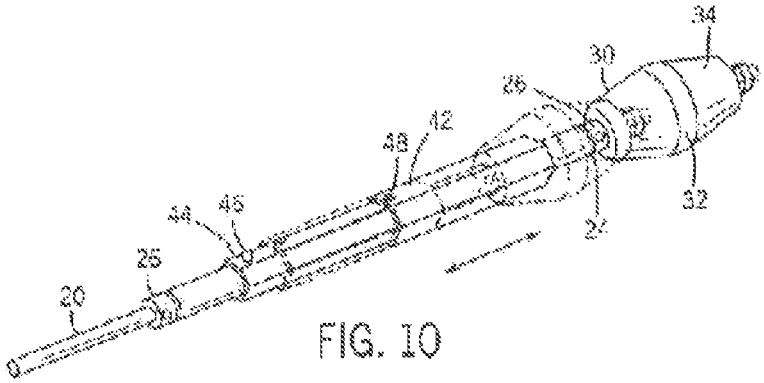
Figure 11:
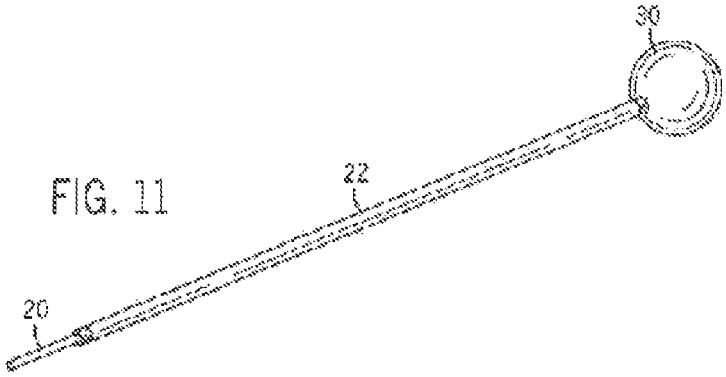
FIG. 11 is a perspective side view of one embodiment of the device, this embodiment having a spherical engagement member.

FIGS. 9A and 9B shows a preferred embodiment, wherein the shaft is telescoping and flexible. The telescoping shaft may be composed of a plurality of shaft components, each of which has a different radius, allowing the shaft components to collapse into each other and extend from each other in order of radius. FIG. 10 shows a preferred embodiment with a telescoping shaft, wherein the shaft is composed of an outer shaft component with a large radius 42 and an inner shaft component with a small radius 44. The shaft components may lock into an extended position using any means known to those of ordinary skill in the art. For example, a pin attached to a spring 46 may slide into a notch 48 in the outer shaft in order to lock the shaft components in place.

What is claimed:

1. A rotating tool having a central longitudinal axis, said rotating tool comprising:

an engagement member, comprising an elastomeric compound, being configured to engage a rotatable object such that the rotatable object rotates at any angle relative to the rotating tool;

a shaft portion being configured to be inserted in a tool holder;

said shaft portion having a first end connected to said engagement member and a second end opposite said first end;

said shaft having one or more of the following attributes: a portion of the shaft is flexible, the shaft is telescoping.

2. A rotating tool comprising:

an engagement member, comprising an elastomeric compound, being configured to engage a rotatable object such that the rotatable object rotates along a longitudinal axis parallel to but not collinear with the longitudinal axis of the rotating tool;

a shaft portion having a central longitudinal axis;

a housing;

a motor encased in the housing;

said shaft portion having a first end connected to said engagement member and a second end connected to said motor; and a locking interconnect for attaching the engagement member to the shaft, the locking interconnect being adapted to selectively permit rotation of the engagement member relative to the housing about the longitudinal axis of the shaft said shaft having one or more of the following attributes: a portion of the shaft is flexible, the shaft is telescoping.

3. A rotating tool comprising:

an engagement member, comprising an elastomeric compound, being configured to engage a rotatable object such that the rotatable object rotates along a longitudinal axis parallel to but not collinear with the longitudinal axis of the rotating tool;

a shaft portion having a central longitudinal axis;

a housing;

a motor encased in the housing;

said shaft portion having a first end connected to said engagement member and a second end connected to said motor; and a locking interconnect for attaching the engagement member to the shaft, the locking interconnect being adapted to selectively permit rotation of the engagement member relative to the housing about the longitudinal axis of the shaft;

said engagement member having one or more of the following attributes: is comprised of a cylinder, a sphere, or a toothed disk.

* * * * *

UNITED STATES PATENT AND TRADEMARK OFFICE

CERTIFICATE OF CORRECTION

PATENT NO. : 9,272,404 B1
APPLICATION NO. : 13/154085
DATED : March 1, 2016
INVENTOR(S) : Christensen It is certified that error appears in the above-identified patent and that said Letters Patent is hereby corrected as shown below:

Specification

In Column 3, Line 53, delete "The shaft 20" and insert -- Fig.1 shows the shaft 20 running through a housing cover 22 and attached to an engagement member 30 in full. The shaft 20 --, therefor.

In Column 3, Line 62, delete "FIG. 6," and insert -- FIG. 5, --, therefor.

In Column 4, Line 2, delete "shaft 38" and insert -- shaft 20 --, therefor.

Signed and Sealed this
Second Day of August, 2016

Michelle K. Lee

Michelle K. Lee
*Director of the United States Patent and Trademark Office*